US007533702B2

(12) United States Patent
Barre

(10) Patent No.: US 7,533,702 B2
(45) Date of Patent: May 19, 2009

(54) METHOD AND DEVICE FOR MANIPULATING HEAVY GAS

(75) Inventor: Luc Barre, Court-Saint-Etienne (BE)

(73) Assignee: ETS Barre, Court-Saint-Etienne (BE)

( * ) Notice: Subject to any disclaimer, the term of this patent is extended or adjusted under 35 U.S.C. 154(b) by 557 days.

(21) Appl. No.: 10/541,770

(22) PCT Filed: Dec. 24, 2003

(86) PCT No.: PCT/BE03/00231

§ 371 (c)(1),
(2), (4) Date: Jul. 8, 2005

(87) PCT Pub. No.: WO2004/062523

PCT Pub. Date: Jul. 29, 2004

(65) Prior Publication Data

US 2006/0107951 A1 May 25, 2006

(30) Foreign Application Priority Data

Jan. 9, 2003 (BE) ..... 2003/0019

(51) Int. Cl.
*B65B 31/04* (2006.01)

(52) U.S. Cl. ..... 141/66; 141/4; 141/8; 141/65

(58) Field of Classification Search ..... 141/63–66, 141/4–8; 128/203.12
See application file for complete search history.

(56) References Cited

U.S. PATENT DOCUMENTS

| | | | | |
|---|---|---|---|---|
| 3,367,308 | A * | 2/1968 | Quattrone et al. | 119/420 |
| 3,877,420 | A * | 4/1975 | Eagleson, Jr. | 119/419 |
| 4,332,244 | A * | 6/1982 | Levy et al. | 128/205.25 |
| 4,807,617 | A * | 2/1989 | Nesti | 128/205.12 |
| 4,941,431 | A * | 7/1990 | Anderson et al. | 119/420 |
| 5,162,101 | A * | 11/1992 | Cosentino et al. | 422/46 |
| 6,352,076 | B1 | 3/2002 | French | |
| 6,776,158 | B1 * | 8/2004 | Anderson et al. | 128/203.12 |
| 7,331,341 | B2 * | 2/2008 | Nelson | 128/203.12 |
| 2007/0095345 | A1 * | 5/2007 | Dalgetty et al. | 128/203.14 |

FOREIGN PATENT DOCUMENTS

DE 370787 3/1923

* cited by examiner

*Primary Examiner*—Timothy L Maust
(74) *Attorney, Agent, or Firm*—Browdy and Neimark, P.L.L.C.

(57) ABSTRACT

The invention relates to a method for manipulating a gas heavier than air in a tank. Said tank comprises a successive closure and opening arranged on the top thereof, an input for said heavy gas into the tank when it is closed and an off for said input when the tank is opened, and a depression unit arranged on the periphery of the top of the tank provided with a unit for sucking out the heavy gas effluent from the top of the tank to a closed chamber.

12 Claims, 3 Drawing Sheets

METHOD AND DEVICE FOR MANIPULATING HEAVY GAS

BACKGROUND OF THE INVENTION

1. Technical Field of the Invention

The present invention relates to Apparatus for manipulating a heavy gas.

Heavy gas means, according to the present invention, a gas heavier than the ambient air.

2. Prior Art

Methods for anaesthetising laboratory animals have already been known for a long time. The appropriate gases used for these anaesthetics are in general heavier than air. They also have the drawback of being, as from certain concentrations in the ambient air, dangerous and even harmful for personnel manipulating these gases. These narcotic gases are also expensive.

The laboratory equipment for manipulating gases at the present time with a view to the anaesthesia of animals, preferably a series of animals, does not have sufficient reliability with regard to the discharge of gases, for the personnel manipulating them. They require a large consumption of gas, since a filling of an anaesthesia chamber with heavy gas and then its purging are required for each anaesthesia of an animal. Briefly, the result of this is an unfavourable slowness of this programme, with high consumption of gas and a risk of putting the health of the operating personnel in danger.

OBJECT AND SUMMARY OF THE INVENTION

The aim of the present invention is to develop apparatus for manipulating a heavier than air gas, which overcomes the aforementioned drawbacks. This apparatus must be safe for operators and have economically favourable probability in use, whilst allowing speed of execution.

It must be understood that a method of animal anaesthesia is not an aim of the invention, the anaesthesia conditions being able to be variable according to requirements due to circumstances, whether this be the mixture of concentrations of the gas, the number of animals to be anaesthetised successively, the animal species to be treated, their weight, etc. On the contrary, the aim of the invention is a method of manipulating the gas which protects the operating personnel, whilst in particular allowing the application of any method of therapeutic treatment, involving the anaesthesia of an animal in a chamber.

To resolve these problems, there has been provided, according to the invention, a method of manipulating heavier than air gas in a chamber, comprising

- a successive closure and opening of the chamber, at the top thereof,
- an introduction of the said heavy gas into the chamber in the closed position thereof and a stoppage of the said introduction in the open position of the chamber, and
- establishment of a negative pressure peripherally at the top of the chamber with suction of heavy gas escaping through the top of the chamber to a confined enclosure.

This method has the advantage that it includes no purge of the chamber during the manipulation. It therefore allows, for example, a successive treatment of several animals by opening the chamber, removing the anaesthetised animal, depositing a new animal to be anaesthetised, and then closure of the chamber, whilst the gas initially introduced into the chamber remains therein. Opening the chamber from the top helps to keep the heavy gas inside the chamber even if the latter is open.

As the introduction of heavy gas is enabled only if the chamber is in the closed position, and if, in the open position of the chamber, the admission of gas must be stopped, there is no risk of inopportune discharge of gas out of the chamber. According to circumstances provision can be made for the opening of the chamber itself to control the interruption of the admission of gas and for opening to be possible only if the admission of gas is interrupted. Likewise, it is possible to provide for the closure of the chamber to automatically control an introduction of gas into the chamber and for this introduction to be possible only after closure of the chamber.

By establishing a negative pressure and a suction peripherally at the top of the chamber, any heavy gas overflowing beyond the top edges of the chamber open at the top is immediately entrained into a confined enclosure, sheltered from the atmosphere respired by the operators. Advantageously, the negative pressure is continued throughout the process, whether the chamber be open or closed.

According to one embodiment of the invention, after each closure in the said series of closures and openings at the top, it comprises an additional introduction of heavy gas into the closed chamber. This is because, when an animal is deposited and then removed, the movement occasioned by its volume and the gas entrained by its hair causes a loss of gas in the chamber, which can thus be rapidly compensated for when the chamber is next closed.

According to one advantageous embodiment of the invention, the method comprises, at the bottom of the chamber, around the latter, a recovery of heavy gas flowing along the chamber from the top to the bottom. Thus, even if heavy gas that has emerged from the chamber has not been sucked by the negative pressure established at the top of the chamber, this gas, which, through its weight, will be deposited licking the walls of the chamber, will be collected also to a confined enclosure away from the operators, preferably the same enclosure.

The invention also concerns an apparatus for manipulating heavier than air gas, comprising

- a chamber having a closable cavity,
- a source of heavy gas which can be in communication with the chamber and allow introduction of the heavy gas into its cavity, and
- means of controlling the said communication between the source and the cavity of the chamber.

According to the invention the chamber comprises an upward opening and a closure means able to be moved between a closed position in which they close off the upward opening and an open position in which it is left clear, and the said control means are capable of passing from a stopped state to a state of leaving clear the said communication and vice versa, the said control means being in the stopped state when the above mentioned closure means are in an open position, and the said closure means being in a closed position when the said control means are in their above mentioned released state, the apparatus also comprising a negative pressure source and means of establishing a negative pressure in a peripheral area at the top of the chamber, which are supplied by the negative pressure source and which suck heavy gas escaping from the chamber from the top into a confined enclosure. Thus it is impossible to open the chamber whilst gas continues to be introduced therein and, conversely, supplying the chamber with gas is impossible when it is open.

According to one advantageous embodiment of the apparatus according to the invention, the said control means comprises a stop valve arranged in a pipe connecting the source of heavy gas and the cavity of the chamber, and a valve control element which is locked mechanically in the abovementioned stopped state when the abovementioned closure means are in the open position and which mechanically lock the closure means in the closed position when it is in the release state. To serve a mechanical locking of this type, it is also possible to provide a locking by the transmission of electrical or electronic signals, by connection systems or by remote transmissions.

It is in particular possible to provide for the said control means to comprise a stop valve arranged in a pipe connecting the source of heavy gas and the cavity of the chamber, and a control member which automatically locks the valve in the stopped state when it detects an output signal from the closure means outside their closure position and which automatically locks the closure means in the closed position when the valve is in the release state.

BRIEF DESCRIPTION OF THE DRAWINGS

Other details and particularities of the invention will emerge from the description given below, non-limitingly, and with reference to the accompanying drawings.

DETAILED DESCRIPTION OF THE PREFERRED EMBODIMENT(S) OF THE INVENTION

In the various figures, the identical or similar elements are designated by the same references.

Figure 1:
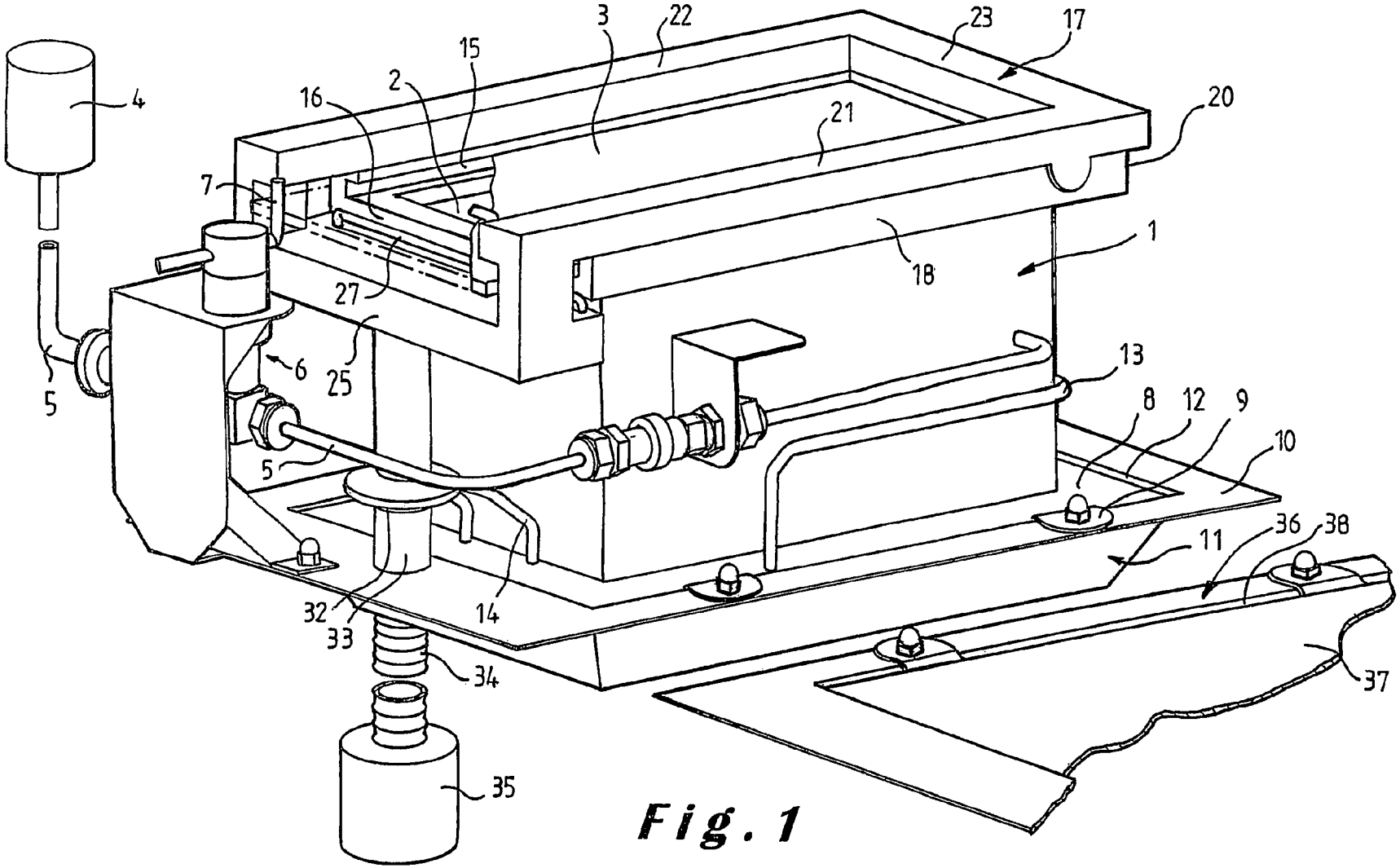
FIG. 1 depicts a view in perspective, partially broken, of a heavy-gas manipulation apparatus according to the invention, in the closed position of the chamber.
Figure 2:
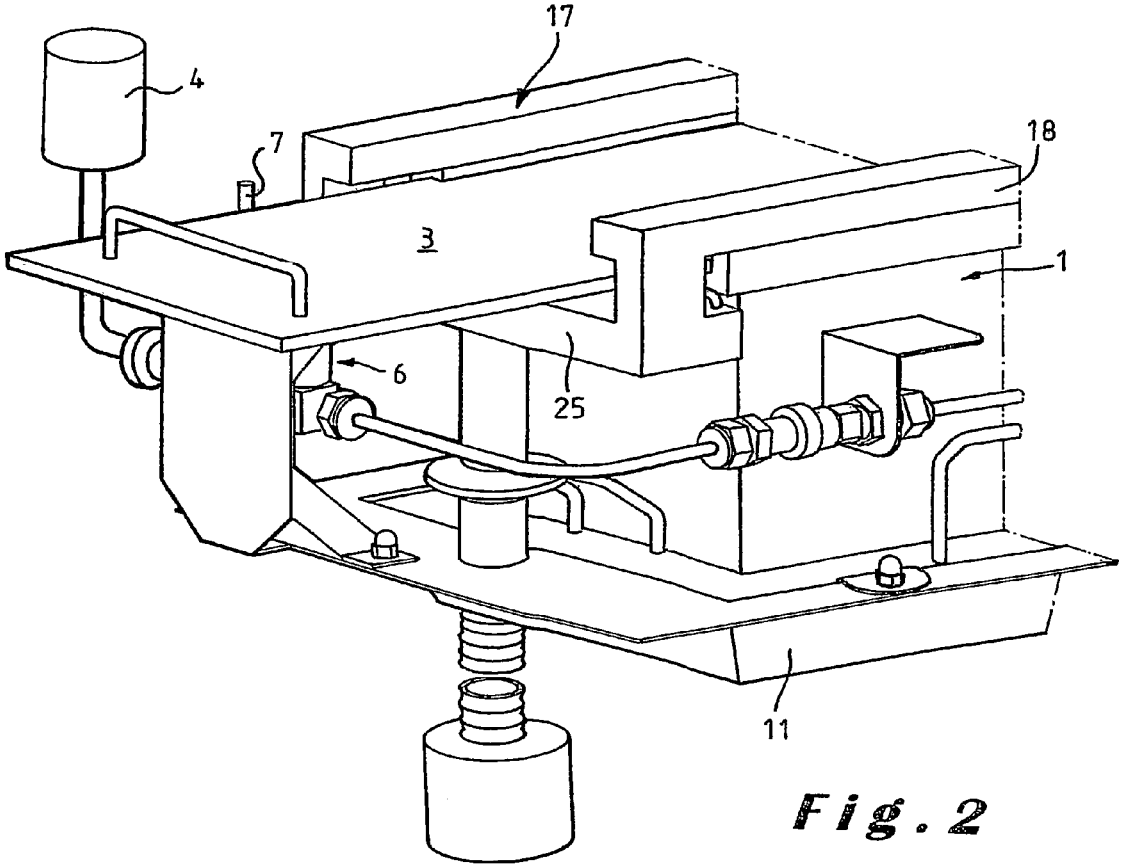
FIG. 2 depicts a view in detail of the apparatus according to FIG. 1, in the open position of the chamber.

As is clear from the figures, the apparatus according to the invention comprises a chamber 1 having a cavity 2 able to be closed in the example illustrated by a cover 3 capable of sliding between a closed position, depicted in FIG. 1, and an open position depicted in FIG. 2. The chamber 1 is open towards the top and therefore, even in the open position, the heavy gas introduced into the chamber has a tendency to remain therein by gravity.

The source 4 of heavy gas, for example a narcotic gas, known per se and depicted solely schematically, is capable of supplying the chamber with gas by means of a pipe 5 in which a stop valve 6, also known per se, is arranged. This valve is controlled by a control element in the form of an angled lever 7, which is depicted in the position of leaving the pipe 5 clear in FIG. 1 and in the position of stoppage of the pipe 5 in FIG. 2.

In the example illustrated, the chamber 1 is supported on a support plate 8 provided with lateral separation lugs 9. By means of these lugs, the support plate 8 can be supported and possibly fixed to the edges 10 of a trough 11 open towards the top, so that the edge of the plate 8 is situated peripherally at a small distance from the trough 8, leaving between them a gap 12. The plate 8 is advantageously supported by the edges 10 of the trough so as to be situated in a plane slightly lower than these. In this example embodiment, the support plate 8 carries guide bars 13, 14 which are conformed so as to receive the chamber, without enabling it to move horizontally during its use.

In the top area of the chamber 1, the latter is provided with a runner 15 in which the cover 3 can slide, which is preferably made from a transparent or translucent material. In the closed position, as depicted in FIG. 1, the cover 3 projects considerably beyond the front top edge 16 of the chamber, sliding over the latter.

Figure 3:
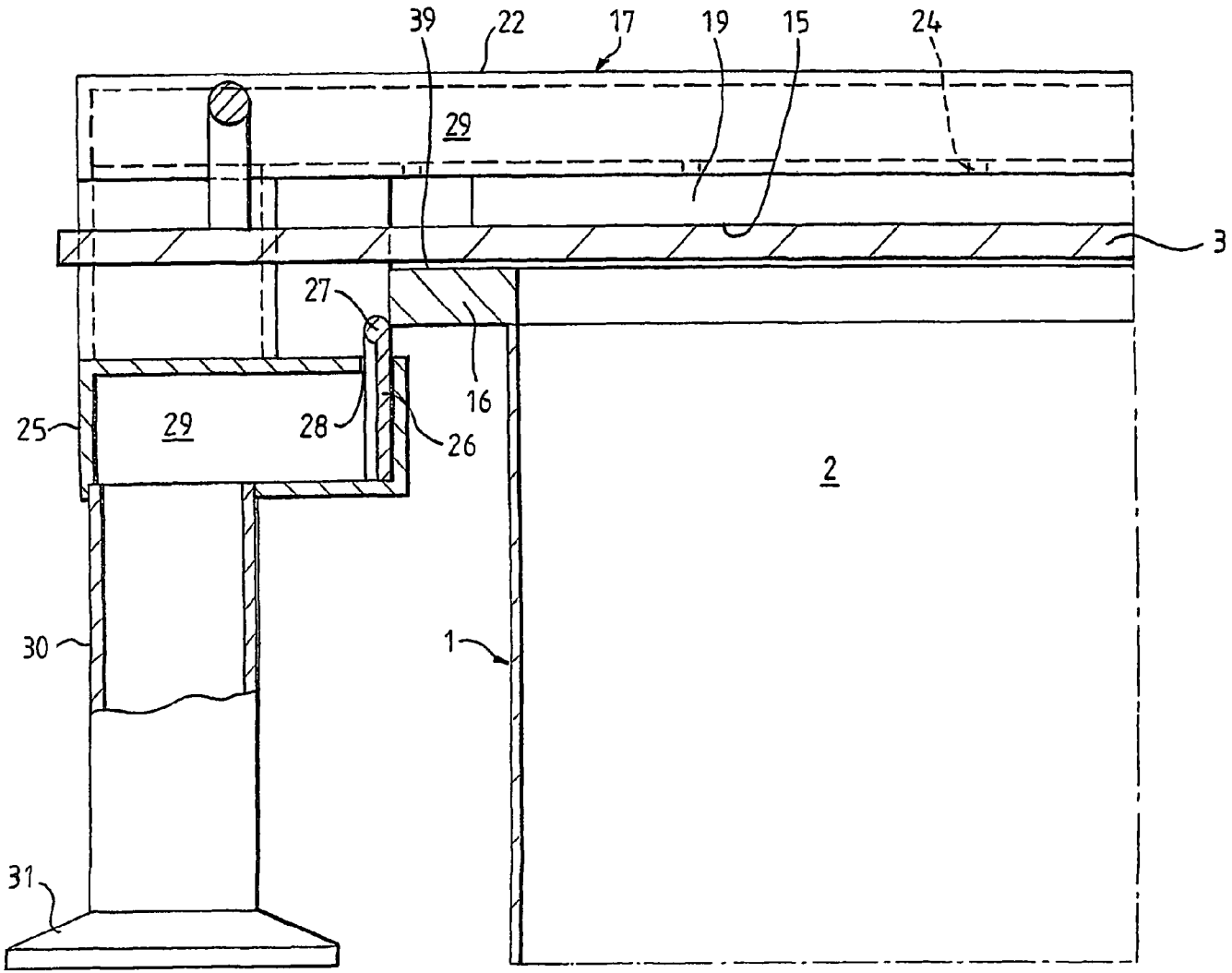
FIG. 3 depicts a view in longitudinal section of part of the apparatus according to FIG. 1.

The apparatus according to the invention also Comprises a top frame 17 which is formed from a hollow profiled section and which is simply placed on the longitudinal top 18 and 19 and rear 20 edges of the chamber. This frame is thus supported at the periphery of the upward opening of the chamber 1. Along the aforementioned three edges 18 to 20, the frame 17 has the shape of a U, the two legs 21 and 22 and the central part 23 of which project towards the inside, thus overhanging the cavity 2. The legs 21 and 22 and the central part 23 of the U are perforated downwards at preferably regular intervals. The perforations 24 afford communication between the chamber and the cavity 29 of the frame 17. The fourth side 25 of the frame, situated at the front, is arranged below the front part of the cover in the closed position (see FIG. 3). A plate 26 provided with a top rim 27 projects on the front side 25 of the frame through a slot 28 provided in the top face thereof. A gap is left between the front edge of the slot 28 and the plate 26 so as to allow communication between the hollow 29 of the frame 17 and the space situated between the cover 3 and the front side 25 of the frame, in front of the front edge 16 of the chamber 1. Advantageously, a narrow passage 39 is left free between the front edge 16 of the chamber and the cover 3.

The front side 25 of the hollow frame 17 is, in the example illustrated, provided with a suction pipe 30, provided with a flange 31 that can be attached to a corresponding flange 29 on a coupling 33 provided on a rim 10 of the trough. This coupling can be put in communication with a flexible pipe 34 which leads to a suction device 35, known per se. It is possible to provide, as shown in FIG. 1, alongside the trough 18 provided with the support plate 8 for the chamber 1, at least one supplementary trough 36, also provided with a central plate 37 supported at a distance from the trough in order to form between the latter and the plate 27 a gap 38. This central plate 37 can serve to support another trough or any other body able to carry narcotic gas.

Like the bottom of the trough 11, the bottom of the trough 36 can be connected in a known manner, not shown, to the suction device 35.

The functioning of the gas manipulation apparatus according to the invention, described above, is as follows.

The chamber 1 is deposited on the support plate 8 of the trough 11, between the guide bars 13, 14. The frame 17 is then deposited on the top edges of the chamber, placing the flange 31 on the flange 32. The cover 3 is slid into the closed position of the chamber 1 and then the valve 6 is mounted.

It is then brought into the position shown in FIG. 1. In this position, the control lever 7 is in abutment against the front edge of the cover 3 and locks the cover in the closed position and the valve 6 is in the open position, that is to say it leaves clear the communication between the heavy gas source 4 and the chamber 1, and allows an introduction of heavy gas into the chamber.

It is then possible to use the heavy gas source 4 so that it supplies the chamber 1 until it is saturated with the said heavy gas.

It is also possible to use the suction device 35 simultaneously, or before or even a little after. The latter creates a slight negative pressure at the top periphery of the chamber 1, above the sides 21 to 23 of the frame 7 and below the cover along the side 25 thereof. The chamber is opened to atmosphere through the passage 39, which channels the gas to the suction slot 28, which prevents any possible leakage of gas in the closed position of the cover.

The lever 7 of the valve 6 can then be turned to the position depicted in FIG. 2. In this position, the communication between the gas source 4 and chamber 1 is stopped. In addition, the lever 7 no longer mechanically locks the cover 3, and has on the contrary passed into a lateral position which allows the opening of the chamber 1. FIG. 2 shows the chamber 1 during this opening operation. The lever 7 is then locked by the cover 3 in the stopped position shown.

It is then possible to introduce a body into the chamber, for example the body of an animal to be anaesthetised, and then the cover is closed again.

During this operation, the heavy gas present in the chamber has a normal tendency to remain in the chamber, because of its heavier than air weight. However, the movement of the cover and the introduction of an additional volume into the chamber have the effect of the heavy gas inevitably overflowing out of the chamber, in particular through the passage 39. This gas is however immediately sucked into the confined enclosure formed by the frame 17, which offers the great advantage of keeping the operators out of contact with the possibly harmful heavy gas.

When the animal is anaesthetised, the chamber is opened once again and the anaesthetised animal is removed, whilst another can immediately be introduced. This is because the chamber remains filled with heavy gas throughout the series of anaesthesiae and it is only necessary to regularly supplement this quantity of gas, for example at each closure, with a quantity of heavy gas equivalent to that which has been sucked away. The result is a great saving in heavy gas.

The anaesthetised animals, which carry narcotic gas in their hair, are advantageously deposited on the deposition plate 37 on a trough 36. The heavy gas then flows slowly from the animal into the trough 36, through the slot 38.

Likewise, if heavy gas manages to escape from the suction of the frame 17, this gas will flow from top to bottom of the chamber 1 and be collected in the trough 11, passing through the slot 12.

It must be understood that the present invention is in no way limited to the embodiment described above and that many modifications can be made thereto without departing from the scope of the accompanying claims.

It is for example possible to envisage a control member which automatically locks the valves in the stopped state when it detects an output signal from the closure means of the chamber outside their closure position and which automatically locks them in the closed position when the valve is open. To this end it is possible to imagine an end of travel switch that detects the position of the cover 3 in the closed position and which emits a signal, for example to a computer, as soon as the cover leaves this closed position, the computer then demanding the opening of the valve 6, which is in the form of a solenoid valve, without any control element 7. It is therefore in this case no longer a question of a mechanical locking but a locking by electrical or electronic signals and the cover itself can serve to trigger the control of the valve, for example trigger the introduction of gas as soon as the above mentioned end of travel switch detects the closed position of the cover.

It is also possible to imagine that, instead of resting on the support plate 8 and supporting the frame 17, the chamber 1 is suspended from the frame 17, itself directly supported by the plate 28, or any work table. This arrangement allows easy detachment of the chamber, for example for cleaning thereof, without having previously to dismantle many components of the apparatus.

The invention claimed is:

1. An apparatus for manipulating heavier than air gas, comprising:

a chamber (1) having a closable cavity (2), a source of heavy gas (4) which communicates with the chamber and allows introduction of the heavy gas into the cavity, control apparatus (6, 7) movable between a first position and a second position to respectively close and open communication between the source (4) and the cavity (2) of the chamber, wherein the chamber (1) comprises an upward opening and closure means (3) movable between a closed position in which the upward opening is closed and an open position in which the upward opening is left open, wherein when the control apparatus (6, 7) is moved to the first position closing said communication, the closure means (3) can be moved to the open position, and when the control apparatus (6, 7) is moved to the second position opening said communication, the closure means (3) when in the closed position cannot be moved to the open position, a negative pressure source (35) and means of establishing a negative pressure (17) in a peripheral area at the top of the chamber , which are supplied by the negative pressure source and which suck heavy gas escaping from the chamber (1) through the top into a confined enclosure, wherein the means of establishing a negative pressure comprise a frame (17) formed by a hollow profile which is supported by the chamber at the periphery of its upward opening and which, on three sides (21-23), overhangs part of the cavity (2) of the chamber and therefore the cover (3) in the closed position, whilst, on a fourth side (25), it is subjacent to a cover in the closed position, and in that the said hollow profiled section is provided, facing the cover in the closed position, with suction openings (24, 28), whilst it is in communication with the said source of negative pressure through an appropriate pipe (30).

2. The apparatus according to claim 1, wherein it also comprises, in an external peripheral area at the bottom of the chamber (1) , means (11) of recovering heavy gas flowing along the chamber from top to bottom.

3. The apparatus according to claim 1, wherein the means of establishing a negative pressure function continuously.

4. The apparatus according to claim 1, wherein the said control apparatus comprise a stop valve (6) arranged in a pipe (5) connecting the heavy gas source (4) and the cavity (2) of the chamber, and a control element (7) for the valve which is locked mechanically in the first position when the closure means (3) is in the open position and which mechanically locks the closure means (3) in the closed position when in the second position.

5. The apparatus according to claim 1, wherein the said control apparatus comprise a stop valve (6) arranged in a pipe (5) connecting the heavy gas source (4) and the cavity (2) of the chamber, and a control member which automatically locks the valve in a stopped state when it detects an output signal from the closure means outside said closed position and which automatically locks the closure means in the closed position when the valve is in a release state.

6. The apparatus according claim 1, wherein the said control apparatus has a stop valve (6) arranged in a pipe (5) connecting the heavy gas source (4) and the cavity (2) of the chamber, and a control member which automatically locks the valve in a stopped state when it detects an output signal from the closure means outside the closed position and which is capable of controlling the valve in a release state when the closure means are in the closed position.

7. The apparatus according to claim 1, wherein the closure means consist of a cover (3) sliding in a runner (15) provided at the upward opening of the chamber (1).

8. The apparatus according to claim 2, wherein the said recovery means comprise a trough (18) open upwards and a support plate (8) for the chamber (1) which is supported substantially in the trough at a distance therefrom.

9. The apparatus according to claim 8, wherein the trough has negative pressure means which act below the support plate and suck the heavy gas recovered by the trough.

10. The apparatus according to claim 8, wherein it also comprises, alongside the trough (11) provided with a support plate (8) for the chamber (1), at least one supplementary trough (36) each provided with a support plate (37) for another chamber and/or for a body carrying heavier than air gas.

11. The apparatus according to claim 2, wherein the means of establishing a negative pressure function continuously.

12. Apparatus for manipulating heavier than air gas, comprising a chamber (1) having a closable cavity (2), an upward opening of said chamber (1) with a closure (3) capable of being moved between a closed position in which the upward opening is closed and an open position in which the upward opening is left open, a source of heavy gas (4) which communicates with the chamber to allow introduction of the heavy gas into the cavity (2)

a negative pressure source (35) and a negative pressure means for establishing a negative pressure (17) in a peripheral area at the top of said chamber (1), supplied by said negative pressure source (35), which negative pressure means (17) sucks heavy gas escaping from the chamber (1) through the top into a confined enclosure, control apparatus (6, 7) movable between a first position and a second position to respectively close and open communication between the source (4) and the cavity (2) of the chamber, wherein the chamber (1) comprises an upward opening and closure means (3) movable between a closed position in which the upward opening is closed and an open position in which the opening is left open, and wherein when the control apparatus (6, 7) is moved to the first position closing said communication, the closure means (3) can be moved to the open position, and when the control apparatus (6, 7) is moved to the second position opening said communication, the closure means (3) when in the closed position cannot be moved to the open position.

* * * * *